US006637100B1

(12) United States Patent
Lin et al.

(10) Patent No.: US 6,637,100 B1
(45) Date of Patent: Oct. 28, 2003

(54) METHOD FOR MOUNTING EXTERNAL HEAT DISSIPATER TO LIGHT EMITTING DIODE

(75) Inventors: Ming-Te Lin, Taipei Hsien (TW); Ming-Yao Lin, Panchiao (TW)

(73) Assignee: Para Light Electronics Co., Ltd., Taipei (TW)

( * ) Notice: Subject to any disclaimer, the term of this patent is extended or adjusted under 35 U.S.C. 154(b) by 0 days.

(21) Appl. No.: 10/236,950

(22) Filed: Sep. 9, 2002

(51) Int. Cl.[7] ..... H01R 43/00

(52) U.S. Cl. ..... 29/827; 29/832; 29/739; 29/742; 29/429

(58) Field of Search ..... 29/417, 429, 426.3, 29/430, 432, 464, 465, 469, 711, 771, 787, 827, 832, 739, 740, 742

(56) References Cited

U.S. PATENT DOCUMENTS 5,027,505 A * 7/1991 Nakamura et al. ..... 29/832
5,067,229 A * 11/1991 Nakamura ..... 29/566.1
5,287,608 A * 2/1994 Ellis ..... 29/33 K

* cited by examiner

*Primary Examiner*—Gregory Vidovich
*Assistant Examiner*—Stephen Kenny
(74) *Attorney, Agent, or Firm*—Troxell Law Office PLLC

(57) ABSTRACT

A method for mounting an external heat dissipater to a light emitting diode is disclosed. The heat dissipater is comprised of at least one heat dissipation board. A long metal strip is conveyed through a working platform and is punched to form a number of heat dissipation boards connected thereto by connection sections. Light emitting diodes are positioned on the heat dissipation boards and the heat dissipation boards are cut and separated from the metal strip to form finished products of light emitting diodes to which a heat dissipater comprised of the heat dissipation board is mounted.

11 Claims, 9 Drawing Sheets

METHOD FOR MOUNTING EXTERNAL HEAT DISSIPATER TO LIGHT EMITTING DIODE

FIELD OF THE INVENTION

The present invention relates generally to the field of light emitting diodes (LEDs), and in particular to a method for mounting an external heat dissipater to the LED for enhancing heat dissipation.

BACKGROUND OF THE INVENTION

Light emitting diodes (LEDs) as a lighting device have the advantages of compact size and less power consumption as compared to the traditional lighting devices. However, due to the limitation in illumination efficiency of the LEDs, the luminance of the LEDs is much less than that of the conventional lightening devices. One way to compensate the poor luminance of the LEDs is to increase the electrical current flowing through the LEDs. Increasing current, however, leads to rise of heat generated. The heat is transmitted to a circuit board on which the LEDs are mounted and dissipated through end faces of the circuit board. The circuit board, however, is generally made of insulation material that is poor in transmitting and dissipating heat.

Light emitting diodes with improved heat dissipation are also available. Such a light emitting diode comprises a substrate on which a light-emitting unit is mounted and a plurality of terminals extending from opposite sides of the substrate. A heat dissipation plate is mounted to the terminals. The heat dissipation plate is soldered to a circuit board when the LED is mounted to the circuit board. The heat dissipation plate increases overall heat dissipation surface for the LED and efficiently transmits heat from the LED to the circuit board. However, heat is still dissipated through the end faces of the circuit board and the dissipation is constrained by the poor heat conductivity of the circuit board.

It is thus desired to additionally mount an efficient heat dissipater to the LEDs to overcome the problems discussed above.

SUMMARY OF THE INVENTION

An object of the present invention is to provide a method for mounting a heat dissipater to an LED to increase the overall heat dissipation surface of the LED.

Another object of the present invention is to provide a method for readily and easily mounting a heat dissipater to an LED device.

To achieve the above objects, in accordance with a first embodiment of the present invention, there is provided a method for mounting a heat dissipater to a light emitting diode, the heat dissipater comprising a heat dissipation board to which the light emitting diode is mounted, the method comprising the following steps: (a) positioning a material strip in a feeder for conveying the material strip through a working platform, a punching device being employed to punch the material strip and forming a number of heat dissipation boards on the material strip; (b) conveying a number of light emitting diodes into the working platform by a supply mechanism; (c) picking up the light emitting diodes and positioning the picked up light emitting diodes on the corresponding heat dissipation boards; (d) cutting and separating the heat dissipation boards on which the light emitting diodes are positioned from the material strip to form finished products of light emitting diodes to which a heat dissipater comprised of the heat dissipation board is mounted; (e) storing the finished products in a storage device; and (f) collecting remaining portion of the material strip with a collection mechanism.

To achieve the above objects, in accordance with a second embodiment of the present invention, there is provided a method for mounting a heat dissipater to a light emitting diode, the heat dissipater comprising first and second heat dissipation boards to which the light emitting diode is mounted, the method comprising the following steps: (a) positioning a first material strip in a feeder for conveying the first material strip through a first working platform, a punching device being employed to punch the first material strip and forming a number of first heat dissipation boards on the first material strip; (b) conveying a number of light emitting diodes into the first working platform by a supply mechanism; (c) picking up the light emitting diodes and positioning the picked up light emitting diodes on the corresponding first heat dissipation boards; (d) positioning a second material strip in a feeder for conveying the second material strip through a second working platform and punching the second material strip to form a number of second heat dissipation boards on the second material strip; (e) cutting and separating the second heat dissipation boards from the second material strip and collecting remaining portion of the second material strip; (f) picking up the second heat dissipation boards and positioning the picked up second heat dissipation boards on the light emitting diodes that are positioned on the first heat dissipation boards; (g) cutting and separating the first heat dissipation boards on which the light emitting diodes and the second heat dissipation boards are positioned from the first material strip to form finished products of light emitting diodes to which a heat dissipater comprised of first and second heat dissipation boards is mounted; (h) storing, the finished products in a storage device; and (i) collecting remaining portion of the first material strip with a collection mechanism.

To achieve the above objects, in accordance with a third embodiment of the present invention, there is provided a method for mounting a heat dissipater to a light emitting diode, the heat dissipater comprising first and second heat dissipation boards to which the light emitting diode is mounted, the method comprising the following steps: (a) forming a number of first heat dissipation boards on a material strip and conveying the material strip through a working platform; (b) positioning a light emitting diode on each first heat dissipation board of the material strip; (c) positioning a second heat dissipation board that is formed on another material strip on the light emitting diode of each first heat dissipation board; (d) cutting the first and second heat dissipation boards on which the light emitting diode is positioned to form a finished product of light emitting diode to which a heat dissipater comprised of first and second heat dissipation boards is mounted; (e) storing the finished products in a storage device; and (f) collecting remaining portions of the material strips with collection mechanisms.

BRIEF DESCRIPTION OF THE DRAWINGS

The present invention will be apparent to those skilled in the art by reading the following description of the best modes for carrying out a process of mounting a heat dissipater to an LED, with reference to the attached drawings, in which.

DETAILED DESCRIPTION OF THE BEST MODES FOR CARRYING OUT THE PRESENT INVENTION

Figure 1:
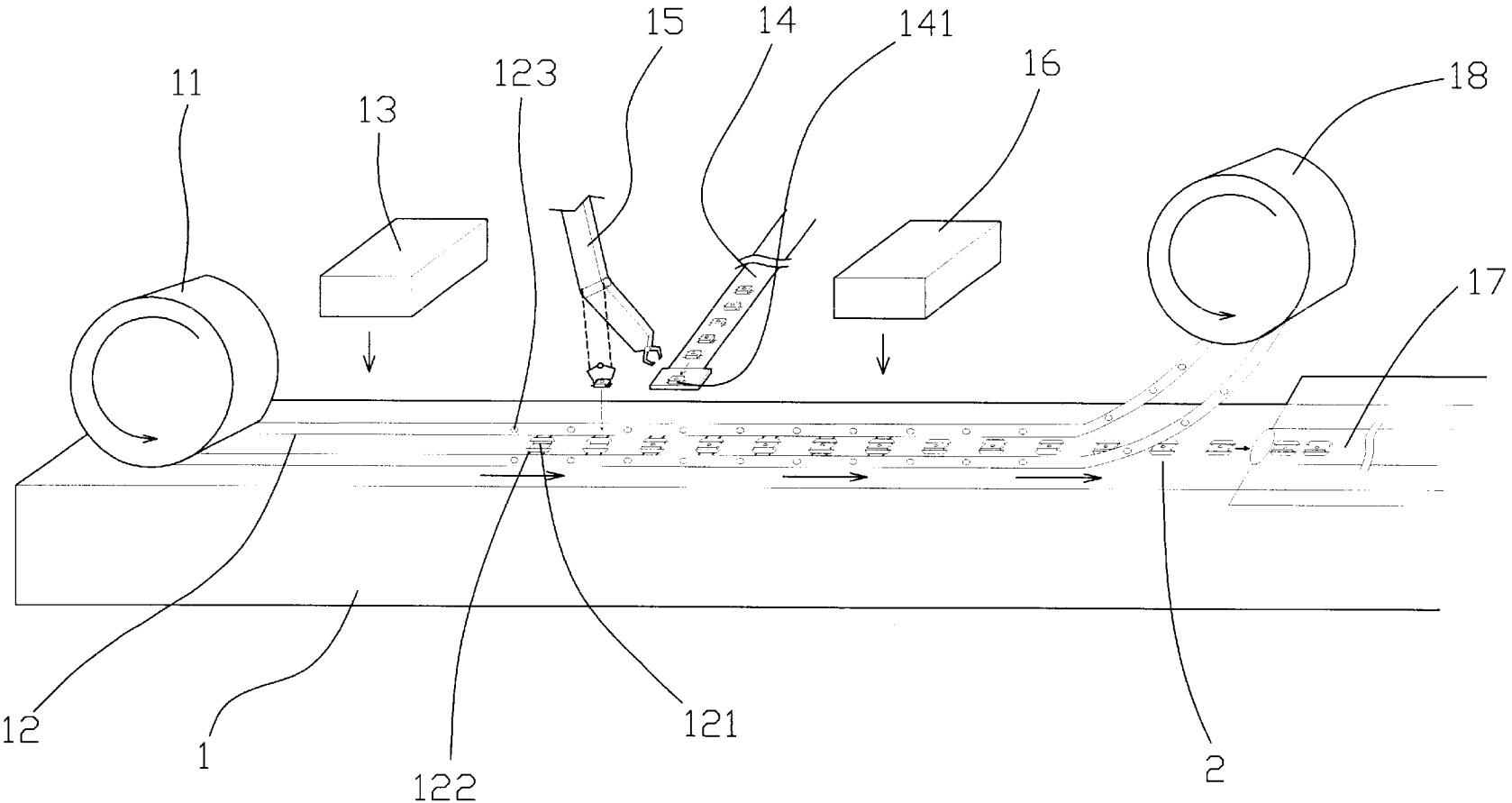
FIG. 1 is a schematic view showing a process of mounting a heat dissipater to a light emitting diode (LED) in accordance with a first embodiment the present invention.
Figure 2:
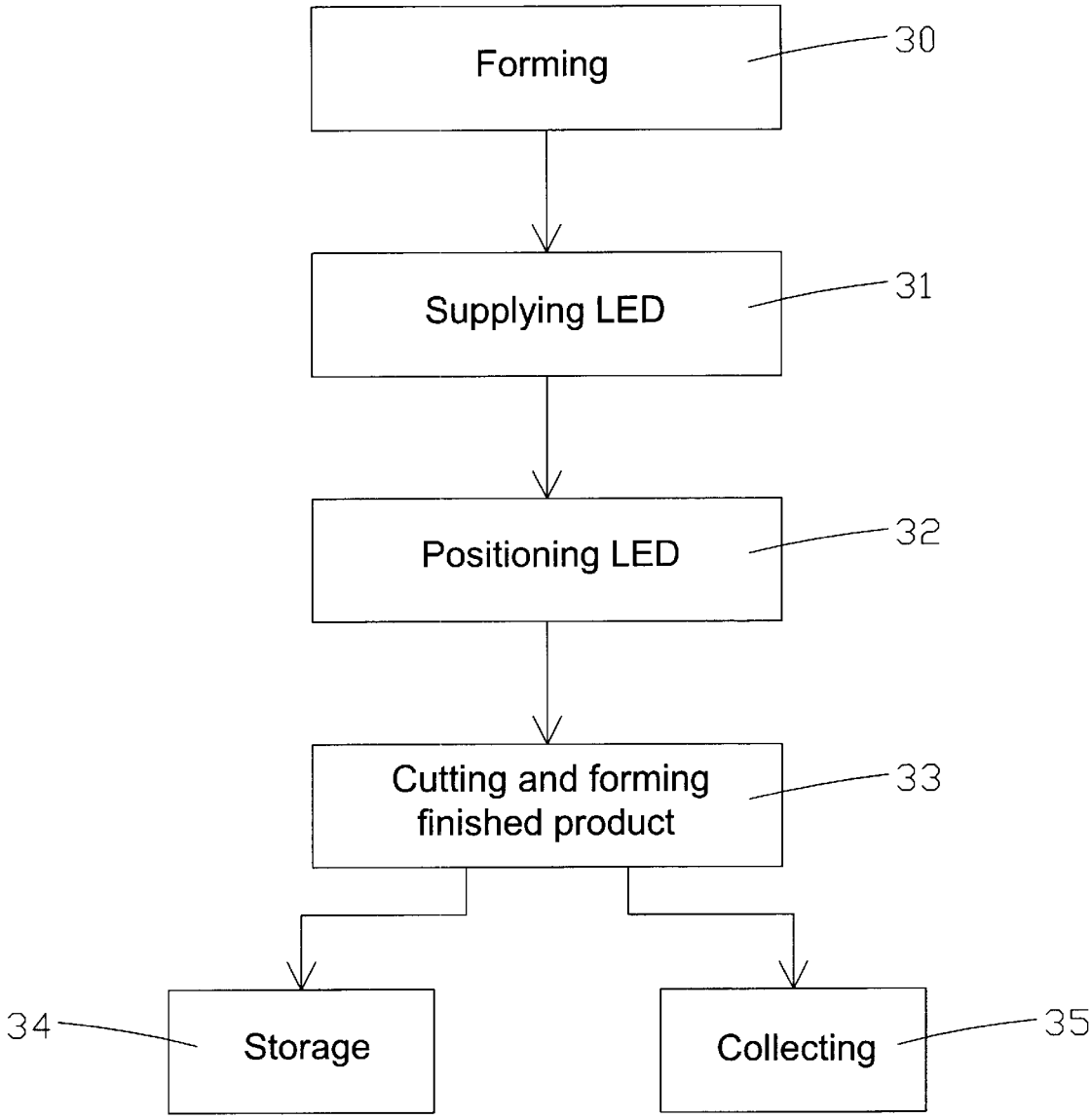
FIG. 2 is a flow chart of the process of the first embodiment of the present invention.

With reference to the drawings and in particular to FIGS. 1 and 2, a process of mounting a heat dissipater to a light emitting diode (LED) is carried out on a working platform 1 and comprises the following steps:

Step a (block 30): A material strip 12 is mounted to a feeder 11 which supplies the material strip 12 through the working, platform 1. The material strip 12 is preferably a long strip of a material having excellent heat conduction, such as metal strip. A punching mechanism 13 punches on the material strip 12 when the material strip 12 is moved through the working platform 1, forming a heat dissipation board 121 which constitutes a heat dissipater to be mounted to an LED. The heat dissipation board 121 remains connected to the material strip 12 by means of one or more carrier sections 122. Positioning holes 123 are formed in the material strip 12, preferably on longitudinal edges thereof for properly positioning the material strip 12 on the working platform 1.

Step b (block 31): An LED supply mechanism 14 conveys a number of LEDs 141 in a sequential manner to the working platform 1. The LED supply mechanism 14 may comprise a chip tube inside which the LEDs 141 are received and retained. Alternatively, the LED supply mechanism 14 comprises a vibration disk for forwarding the LEDs to the working platform 1 by means of continuous vibration.

Step c (block 32): A pick-up device 15 picks up the LEDs 141 one by one and positions the picked-up LED 141 on corresponding ones of the heat dissipation boards 121 formed on the material strip 12.

Figure 3:
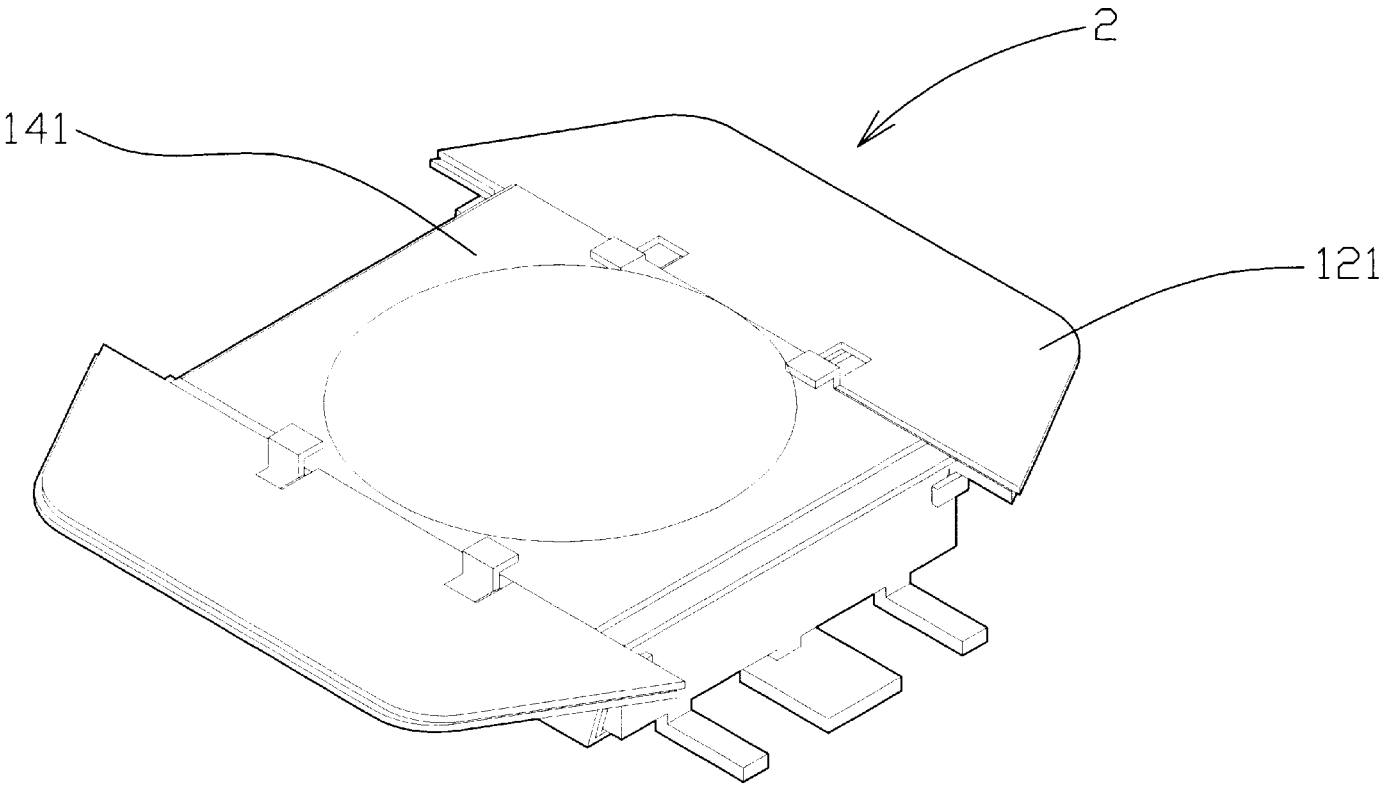
FIG. 3 is a perspective view of an LED to which a heat dissipater is mounted in accordance with the present invention.

Step d (block 33): A cutting mechanism 16 is then employed to cut and separate the heat dissipation boards 12 on which the LEDs 141 are positioned from the material strip 12 whereby a finished product 2 (as shown in FIG. 3) of the LED mounted in the heat dissipation board 121 is completed.

Step e (block 34): The finished LED 2 is then positioned into a storage device 17.

Step f (block 35): The remaining portion of the material strip 12 is collected by a collection mechanism 18. Thus, the LED mounted with a heat dissipation board for increasing the overall heat dissipation surface thereof is completed.

Figure 4:
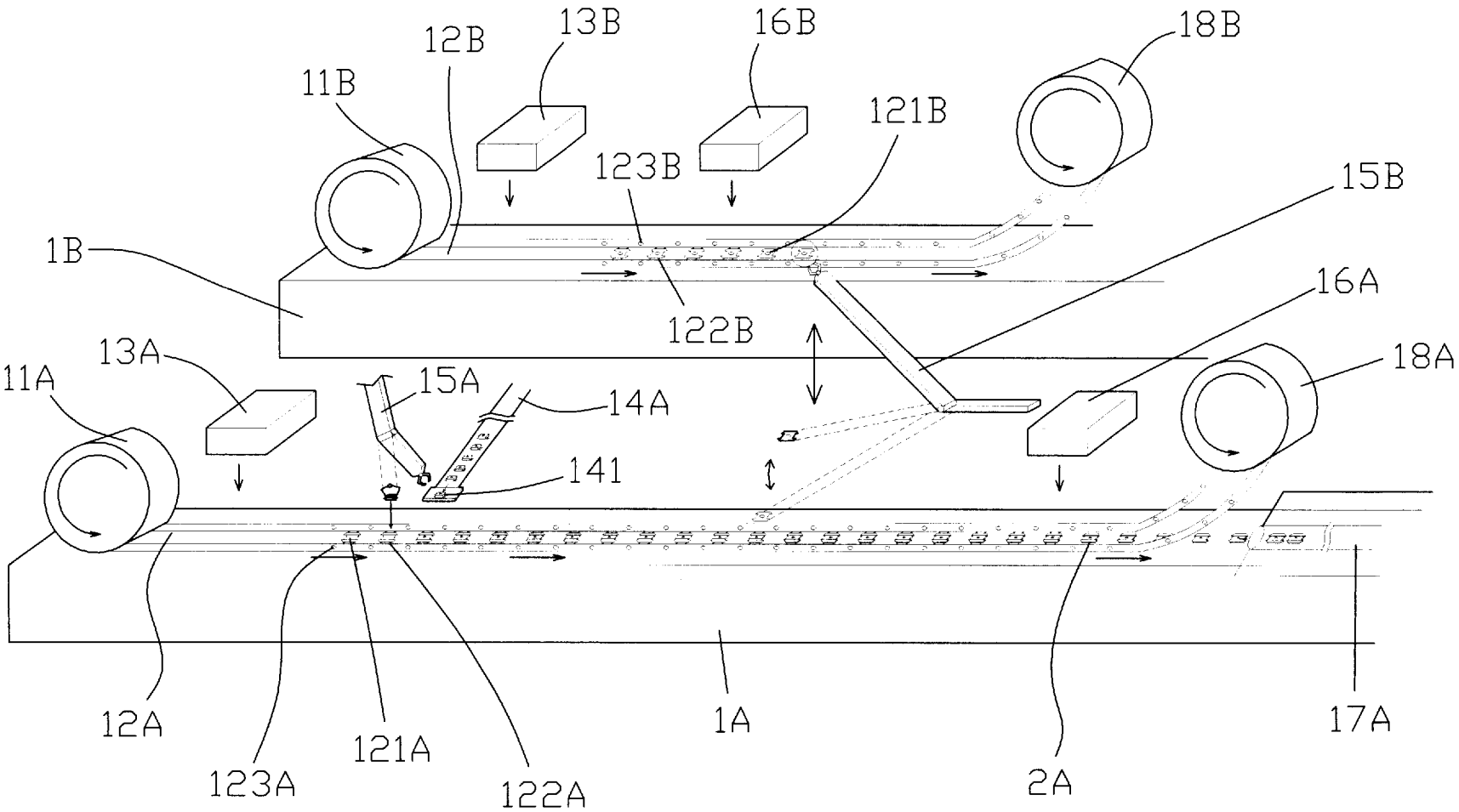
FIG. 4 is a schematic view showing a process of mounting a heat dissipater to an LED in accordance with a second embodiment of the present invention.
Figure 5:
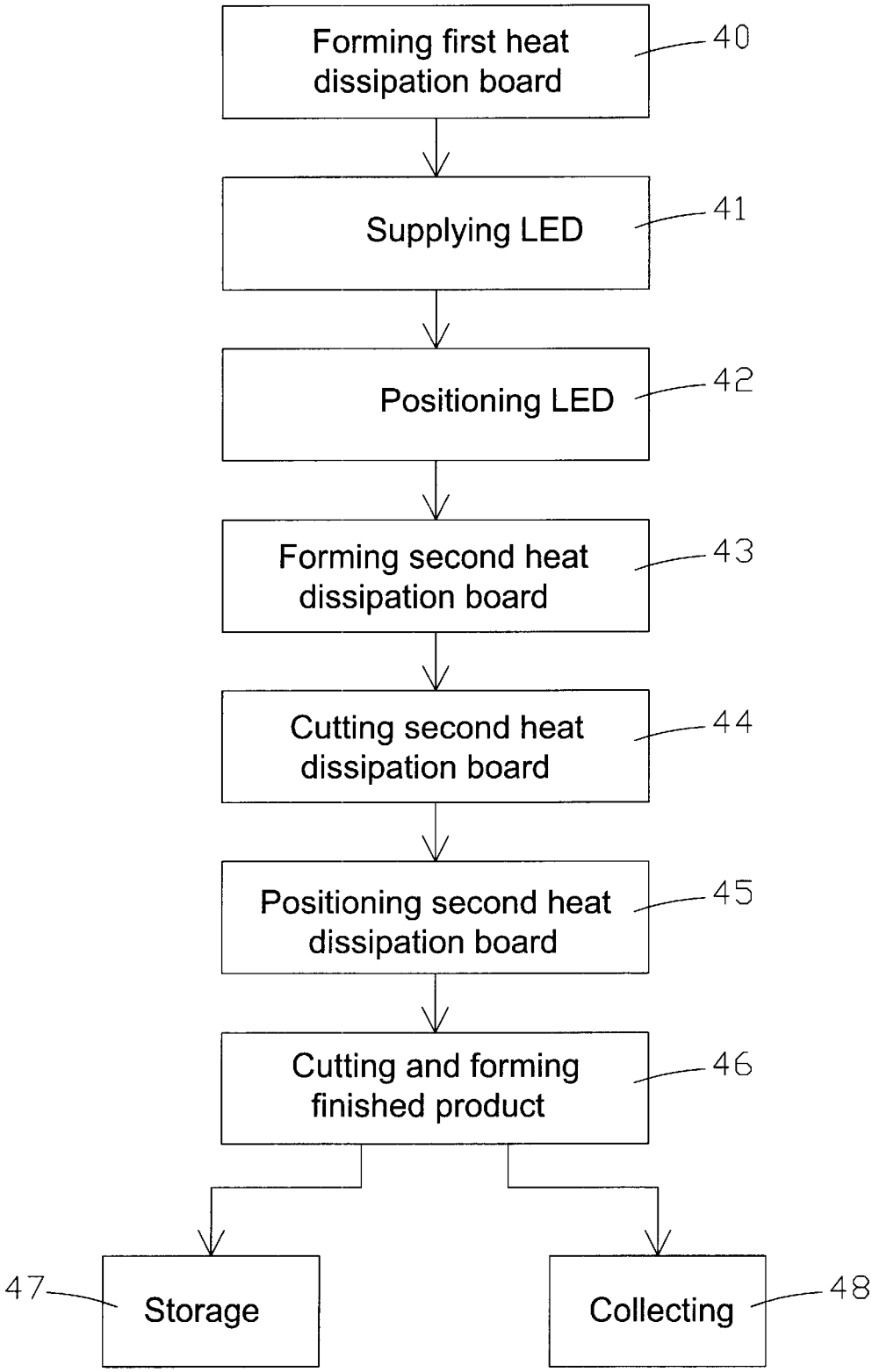
FIG. 5 is a flow chart of the process of the second embodiment of the present invention.

With reference to FIGS. 4 and 5, a process of mounting a heat dissipater to an LED in accordance with a second embodiment of the present invention is carried out on working platforms 1A and 1B and comprises the following steps:

Step a (block 40): A first material strip 12A is mounted to a first feeder 11A on the working platform 1A, allowing the first material strip 12A to be supplied to and through the working platform 1A. The first material strip 12A is preferably a long strip of a material having excellent heat conduction, such as metal strip. A punching mechanism 13A punches on the first material strip 12A when the first material strip 12A is moved through the working platform 1A, forming a first heat dissipation board 121A which constitutes partly a heat dissipater to be mounted to an LED The first heat dissipation board 121A remains connected to the first material strip 12A by means of one or more carrier sections 122A. Positioning holes 123A are formed in the first material strip 12A, preferably on longitudinal edges thereof for properly positioning the first material strip 12A on the working platform 1A.

Step b (block 41): An LED supply mechanism 14A conveys a number of LEDs 141 in a sequential manner to the working platform 1A. The LED supply mechanism 14 may comprise a chip tube inside which the LEDs 141 are received and retained. Alternatively, the LED supply mechanism 14 comprises a vibration disk for forwarding the LEDs to the working platform 1A by means of continuous vibration.

Step c (block 42): A pick-up device 15A picks up the LEDs 141 one by one and positions each picked-up LED 141 on a corresponding one of the first heat dissipation boards 121A formed on the first material strip 12A.

Step d (block 43): A second material strip 12B is mounted to a second feeder 11B on the working platform 1B, allowing the second material strip 12B to be supplied to and through the working platform 1B. The second material strip 12B is preferably a long strip of a material having excellent heat conduction, such as metal strip. A punching mechanism 13B punches on the second material strip 12B, forming a second heat dissipation board 121B which constitutes partly the heat dissipater to be mounted to an LED. The second heat dissipation board 121B remains connected to the second material strip 12B by means of one or more carrier sections 122B. Positioning holes 123B are formed in the second material strip 12B, preferably on longitudinal edges thereof for properly positioning the second material strip 12B on the working platform 1B.

Step e (block 44): A cutting mechanism 16B is employed to cut and separate the second heat dissipation boards 121B from the second material strip 12B and a collection mechanism 18B collects the remaining portion of the second material strip 12B.

Step f (block 45): A pick-up device 15B picks up the second heat dissipation boards 121B one by one and positions each picked-up second heat dissipation board 121B on the LED 141 of the corresponding first heat dissipation board 121A.

Figure 6:
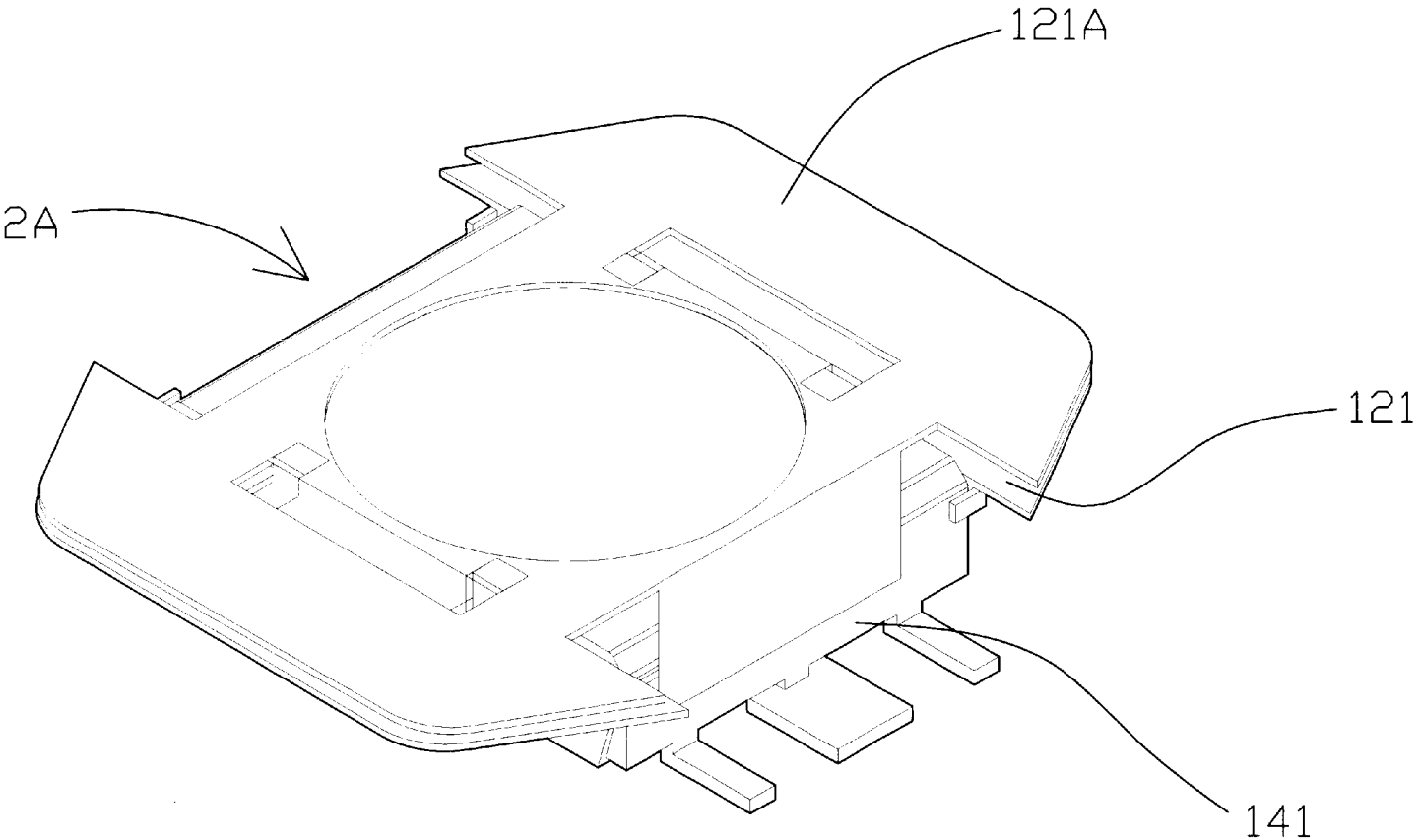
FIG. 6 is a perspective view of an LED to which a heat dissipater is mounted in accordance with the second embodiment of the present invention.

Step g (block 46): A cutting mechanism 16A in the working platform 1A is then employed to cut and separate the first heat dissipation boards 121A on which the LEDs 141 and the second heat dissipation boards 121B are positioned from the first material strip 12A whereby a finished product 2A (as shown in FIG. 6) of the LED mounted in the first and second heat dissipation boards 121A, 121B is completed.

Step h (block 47): The finished LED 2A is then positioned into a storage device 17A.

Step i (block 48): The remaining portion of the first material strip 12A is collected by a collection mechanism 18A. Thus, the LED mounted with heat dissipation boards for increasing the overall heat dissipation surface thereof is completed.

Figure 7:
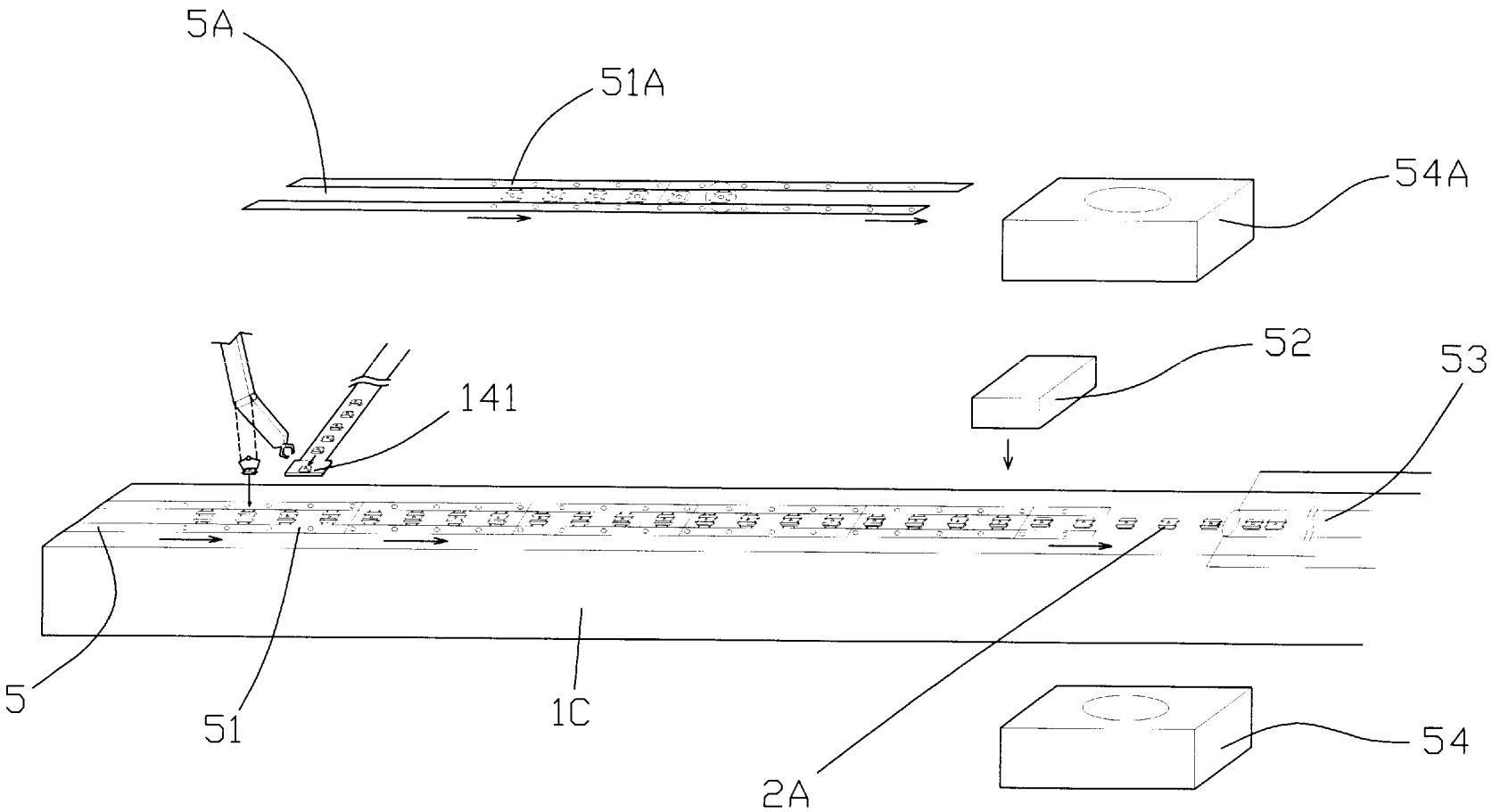
FIG. 7 is a schematic view showing a process of mounting a heat dissipater to an LED in accordance with a third embodiment of the present invention.
Figure 8:
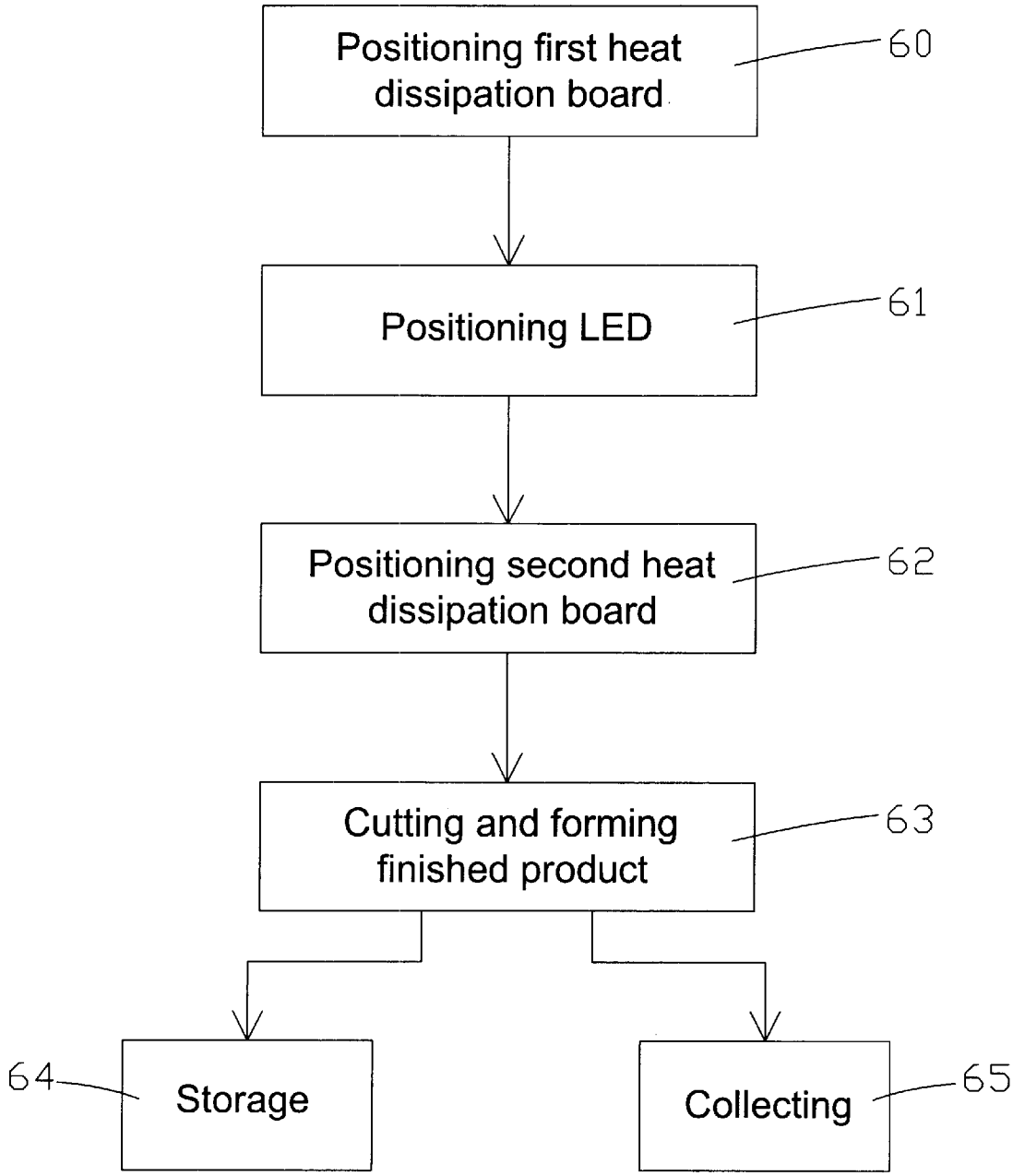
FIG. 8 is a flow chart of the process of the third embodiment of the present invention.

With reference to FIGS. 7 and 8, a process of mounting a heat dissipater to an LED is carried out on a working platform 1C and comprises the following steps:

Step a (block 60): A material strip 5 on which a number of first heat dissipation boards 51 are formed is conveyed along the working platform 1C.

Step b (block 61): An LED 141 is positioned on each of the first heat dissipation boards 51.

Step c (block 62): A second material strip 5A is punched and forms a number of second heat dissipation boards 51A and each second heat dissipation board 51A is positioned on and covering the LED 141 on each first heat dissipation board 51.

Figure 9:
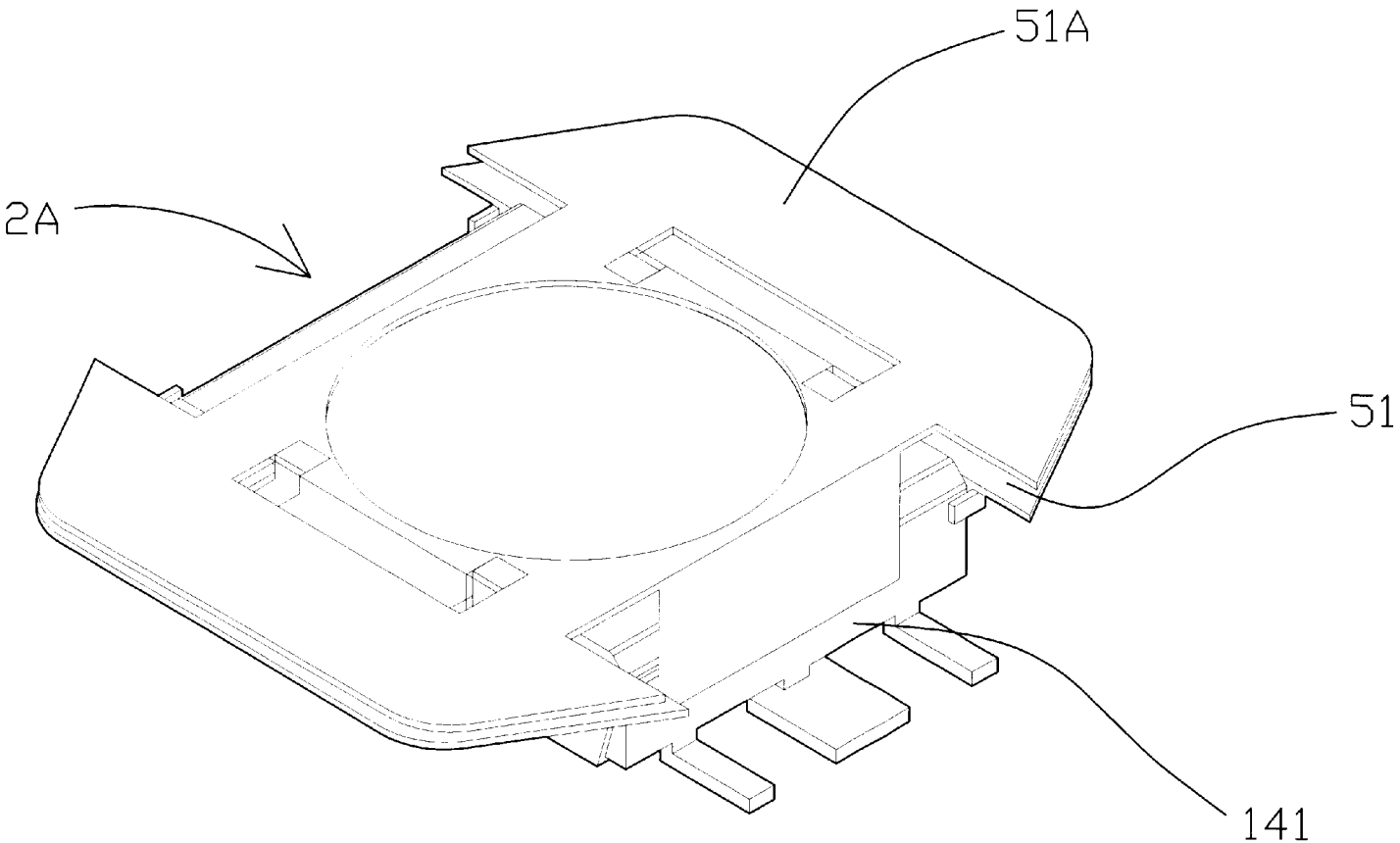
FIG. 9 is a perspective view of an LED to which a heat dissipater is mounted in accordance with the third embodiment of the present invention.

Step d (block 63): A cutting mechanism 52 is then employed to cut off the first and second heat dissipation boards 51, 51A to form a finished product 2A (as shown in FIG. 9) of the LED mounted in the heat dissipation boards 51, 51A is completed.

Step e (block 64): The finished LED 2A is then positioned into a storage device 53.

Step f (block 65): The remaining portions of the first and second material strips 5, 5A are respectively collected by collection mechanisms 54, 54A. Thus, the LED mounted with heat dissipation boards for increasing the overall heat dissipation surface thereof is completed.

Although the present invention has been described with reference to the best modes for carrying out the invention, it is apparent to those skilled in the art that a variety of modifications and changes may be made without departing from the scope of the present invention which is intended to be defined by the appended claims.

What is claimed is:

1. A method for mounting a heat dissipater to a light emitting diode, the heat dissipater comprising a heat dissipation board to which the light emitting diode is mounted, the method comprising the following steps:

(a) positioning a material strip in a feeder for conveying the material strip through a working platform, a punching device being employed to punch the material strip and forming a number of heat dissipation boards on the material strip;

(b) conveying a number of light emitting diodes into the working platform by a supply mechanism;

(c) picking up the light emitting diodes and positioning the picked up light emitting diodes on the corresponding heat dissipation boards;

(d) cutting and separating the heat dissipation boards on which the light emitting diodes are positioned from the material strip to form finished products of light emitting diodes to which a heat dissipater comprised of the heat dissipation board is mounted;

(e) storing the finished products in a storage device; and (f) collecting remaining portion of the material strip with a collection mechanism.

2. The method as claimed in claim 1, wherein the material strip comprises a metal strip having excellent heat conduction.

3. The method as claimed in claim 1 wherein the heat dissipation boards that are formed by punching the material strip remain connected to the material strip with connection section, positioning holes being formed on the material strip for properly positioning the material strip on the working platform.

4. The method as claimed in claim 1, wherein the supply mechanism comprises at least one chip tube.

5. The method as claimed in claim 1, wherein the supply mechanism comprises a vibration disk.

6. A method for mounting a heat dissipater to a light emitting diode, the heat dissipater comprising first and second heat dissipation boards to which the light emitting diode is mounted the method comprising the following steps:

(a) positioning a first material strip in a feeder for conveying the first material strip through a first working platform, a punching device being employed to punch the first material strip and forming a number of first heat dissipation boards on the first material strip;

(b) conveying a number of light emitting diodes into the first working platform by a supply mechanism;

(c) picking up the light emitting diodes and positioning the picked up light emitting diodes on the corresponding first heat dissipation boards;

(d) positioning a second material strip in a feeder for conveying the second material strip through a second working platform and punching the second material strip to form a number of second heat dissipation boards on the second material strip, (e) cutting and separating the second heat dissipation boards from the second material strip and collecting remaining portion of the second material strip;

(f) picking up the second heat dissipation boards and positioning the picked up second heat dissipation boards on the light emitting diodes that are positioned on the first heat dissipation boards;

(g) cutting and separating the first heat dissipation boards on which the light emitting diodes and the second heat dissipation boards are positioned from the first material strip to form finished products of light emitting diodes to which a heat dissipater comprised of first and second heat dissipation boards is mounted;

(h) storing the finished products in a storage device; and (i) collecting remaining portion of the first material strip with a collection mechanism.

7. The method as claimed in claim 6, wherein the first and second material strips comprise metal strips having excellent heat conduction.

8. The method as claimed in claim 6, wherein the first and second heat dissipation boards that are formed by punching the first and second material strips remain connected to the first and second material strips with connection sections, positioning holes being formed on the first and second material strips for properly positioning the first and second material strips on the first and second working platforms.

9. The method as claimed in claim 6, wherein the supply mechanism comprises at least one chip tube.

10. The method as claimed in claim 6, wherein the supply mechanism comprises a vibration disk.

11. A method for mounting a heat dissipater to a light emitting diode, the heat dissipater comprising first and second heat dissipation boards to which the light emitting diode is mounted, the method comprising the following steps:

(a) forming a number of first heat dissipation boards on a material strip and conveying the material strip through a working platform, (b) positioning a light emitting diode on each first heat dissipation board of the material strip;

(c) positioning a second heat dissipation board that is formed on another material strip on the light emitting diode of each first heat dissipation board;

(d) cutting the first and second heat dissipation boards on which the light emitting diode is positioned to form a finished product of light emitting diode to which a heat dissipater comprised of first and second heat dissipation boards is mounted;

(e) storing the finished products in a storage device and (f) collecting remaining portions of the material strips with collection mechanisms.

* * * * *